US009823010B2

(12) United States Patent
Boarman

(10) Patent No.: US 9,823,010 B2
(45) Date of Patent: Nov. 21, 2017

(54) LOW ENERGY EVAPORATOR DEFROST

(71) Applicant: Whirlpool Corporation, Benton Harbor, MI (US)

(72) Inventor: Patrick J. Boarman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/662,271

(22) Filed: Mar. 19, 2015

(65) Prior Publication Data

US 2015/0192348 A1 Jul. 9, 2015

Related U.S. Application Data

(63) Continuation of application No. 13/656,801, filed on Oct. 22, 2012, now Pat. No. 8,997,507.

(51) Int. Cl.
*F25D 21/12* (2006.01)
*F25D 21/14* (2006.01)
*F25D 17/06* (2006.01)

(52) U.S. Cl.
CPC ..... *F25D 21/125* (2013.01); *F25D 21/12* (2013.01); *F25D 21/14* (2013.01); *F25D 17/065* (2013.01)

(58) Field of Classification Search
CPC ..... F25D 21/14; F25D 21/125; F25D 21/12; F25D 17/065; F25D 21/006; F25D 21/08; F25D 2700/10; F25D 2700/123; F25D 2700/02; F25D 2700/14; F25B 2600/0253; F25B 2600/111; F25B 2600/23; Y02B 30/743; Y02B 30/741
USPC ..... 62/82, 282
See application file for complete search history.

(56) References Cited

U.S. PATENT DOCUMENTS 3,937,033 A * 2/1976 Beckwith ..... F25D 21/125 62/155
4,006,601 A 2/1977 Ballarin et al.
4,072,488 A * 2/1978 Johnston ..... F25D 21/125 62/282
4,086,779 A 5/1978 Lewis
4,122,687 A * 10/1978 McKee ..... F25D 21/12 62/156
4,144,720 A * 3/1979 Subera ..... A47F 3/0447 415/149.2
4,208,884 A 6/1980 Popham
(Continued)

FOREIGN PATENT DOCUMENTS

KR 100206801 B1 7/1999

*Primary Examiner* — Mohammad M Ali

(57) ABSTRACT

A refrigerator is provided that includes a low energy defrost system and method for melting frost formed on an evaporator of a cooling system for the refrigerator. The low energy defrost system includes using air from the refrigerator compartment or external air adjacent the refrigerator to be directed to the evaporator and passed adjacent the evaporator coils to melt any frost formed thereon. As the air is above freezing temperature, it will melt any frost formed on the coils without the need of use an electrical heater. Re-cooled air from the melted frost may then be directed back into the refrigerator compartment to be used to aid in cooling the refrigerator compartment or keeping the refrigerator compartment at the programmed or predetermined temperature.

17 Claims, 7 Drawing Sheets

(56) References Cited

U.S. PATENT DOCUMENTS 4,239,518 A * 12/1980 Steelman ..... A47F 3/0408 62/282
4,304,098 A * 12/1981 Rydahl ..... A47F 3/0447 62/151
4,337,626 A * 7/1982 Ibrahim ..... F25D 21/125 62/256
4,347,710 A 9/1982 Ibrahim
4,361,012 A 11/1982 Ibrahim
4,375,155 A * 3/1983 Rosanio ..... A47F 3/0408 62/256
4,375,750 A * 3/1983 Blomberg ..... F25B 15/10 62/101
4,399,662 A * 8/1983 Ibrahim ..... F25D 21/125 62/256
4,474,029 A 10/1984 Kennon
4,478,047 A 10/1984 Ibrahim
4,714,304 A * 12/1987 Sisk ..... F25D 23/062 29/897.3
4,776,182 A 10/1988 Gidseg
5,386,709 A * 2/1995 Aaron ..... F25B 5/02 62/199
5,440,894 A * 8/1995 Schaeffer ..... F25B 1/00 62/203
5,557,942 A * 9/1996 Kim ..... F25D 17/047 62/288
5,586,441 A 12/1996 Wilson et al.
5,713,215 A 2/1998 Choi
5,931,004 A 8/1999 Yoo et al.
6,526,767 B1 3/2003 Lopes
7,908,873 B1 3/2011 Cur et al.
2002/0100139 A1* 8/2002 Rowley ..... F16L 5/025 16/2.1
2003/0145611 A1 8/2003 McGill
2005/0103029 A1* 5/2005 Kawahara ..... F25D 29/008 62/126
2008/0072611 A1* 3/2008 Ahmed ..... F25B 49/02 62/175
2010/0011801 A1* 1/2010 Ritchie ..... F25D 17/065 62/441

* cited by examiner

LOW ENERGY EVAPORATOR DEFROST

CROSS-REFERENCE TO RELATED APPLICATIONS

This is a Continuation Application of U.S. application Ser. No. 13/656,801, filed on Oct. 22, 2012, the entire disclosure of which is expressly incorporated herein by reference.

FIELD OF THE INVENTION

The invention relates generally to refrigerators. More particularly, but not exclusively, the invention relates to a refrigerator having a cooling system wherein an evaporator is defrosted using air from a compartment of the refrigerator having a temperature above freezing.

BACKGROUND OF THE INVENTION

Bottom mount refrigerators include a freezer compartment on the bottom, with the fresh food or refrigerator compartment above the freezer compartment. One or more doors provide access to the fresh food compartment, and a separate door provides access to the freezer compartment. The freezer door or doors may be drawer-type doors that are pulled out, or they may be hingedly connected similar to the refrigerator compartment doors, such that they are rotated to provide access within.

The refrigerator and freezer compartments may be cooled using a single evaporator cooling system, in which the single evaporator cools air to be directed to the compartments to keep them at a predetermined temperature, or the refrigerator may include a dual evaporator system. Dual evaporator systems include two evaporators in the cooling cycle, with the separate evaporators dedicated to cooling air for a specific compartment (i.e., one evaporator for the refrigerator compartment, and one for the freezer compartment).

A cooled refrigerant is passed through the evaporator. The cold liquid-vapor mixture of refrigerant travels through the evaporator coil or tubes and is completely vaporized by cooling the warm air (from the space being refrigerated) being blown by a fan across the evaporator coil or tubes. However, because the refrigerant that passes through the coils of the evaporator is at a cold temperature, frost can form on the coils, especially when the cooling system is cooling a freezer compartment or other low temperature compartment. If too much frost forms on the coils, the evaporator will freeze up, and the cooling system will not properly cool the compartment(s) of the refrigerator.

Therefore, defrost systems are placed on or near the evaporators to aid in melting the frost off the coils, generally when the cooling system is not running (i.e., when the temperatures of the compartment(s) are at or below the set/predetermined temperatures). Most refrigerator evaporators use an electrical heater to defrost. The frost melts off the evaporator coils and drains to a pan in the machine compartment. The water in the pan evaporates into the air, which is routed to room air. The use of an electrical heater requires electricity to warm the heater, which can increase the cost of electricity required to run the refrigerator.

As the costs of energy increases, consumers have demanded low energy appliances to try to keep their bills at a minimum. Therefore, there is a need in the art for a low energy solution to defrost the evaporator coils in a refrigerator cooling system, which includes removing an electrical heater or warming component from the evaporator coils.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide a low energy solution to defrost evaporator coils in a refrigerator cooling system.

It is yet another object, feature, and/or advantage of the present invention to provide a low energy defrost solution that includes using above-freezing air from the refrigerator compartment to defrost the evaporator coils.

It is still another object, feature, and/or advantage of the present invention to provide a low energy defrost solution that includes directing ambient air from outside the refrigerator to the evaporator to defrost the evaporator coils.

It is a further object, feature, and/or advantage of the present invention to provide a low energy defrost solution that can defrost coils on multiple evaporators.

It is still a further object, feature, and/or advantage of the present invention to provide a low energy defrost solution that combines air from the refrigerator compartment and ambient external air to defrost the coils on the one or more evaporators.

It is yet a further object, feature, and/or advantage of the present invention to provide a defrost solution for an evaporator of a refrigerator cooling system that aids in lowering the energy costs of a consumer.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, a refrigerator is provided. The refrigerator includes a refrigerator compartment and a freezer compartment. An evaporator is provided for cooling both the refrigerator and the freezer compartment. A defrost air loop is provided for directing refrigerator compartment air from the refrigerator compartment to the evaporator and back to the refrigerator compartment, wherein the refrigerator compartment air is configured to melt frost on the evaporator and cool, and wherein the cooled air is returned to the refrigerator compartment. An evaporator pan is operably connected to the evaporator and configured to store the melted frost of the evaporator.

According to another aspect of the present invention, a defrost air loop assembly for defrosting an evaporator of a cooling system is provided. The assembly includes a first compartment having a temperature above freezing; a second compartment having a temperature below freezing; a first air duct between the evaporator and the first compartment; and a return duct between the first compartment and the evaporator to direct above freezing air to the evaporator to defrost said evaporator.

According to yet another aspect of the present invention, a method of defrosting an evaporator of a cooling system of a refrigerator is provided. The method includes providing an air duct and a return duct between the evaporator and a first compartment of the refrigerator having a temperature above freezing; directing the above freezing temperature in the return duct to the evaporator; and redirecting the air from the evaporator through the air duct to the first compartment to aid in cooling the compartment.

The invention involves using refrigerator compartment air to melt frost on evaporator coils. The refrigerator compartment air is above freezing. Drawing forced air in a loop to the evaporator and back will melt the ice on the evaporator.

It will also recapture the latent heat of fusion from the frost. The system will not waste energy through electrical heat. Melt water will be routed to the evaporator pan in the machine compartment. Alternatively, an air stream directly to and from the exterior of the product can be used for defrost, instead of using refrigerator compartment air.

DETAILED DESCRIPTION OF THE PREFERRED EMBODIMENTS

Figure 1:
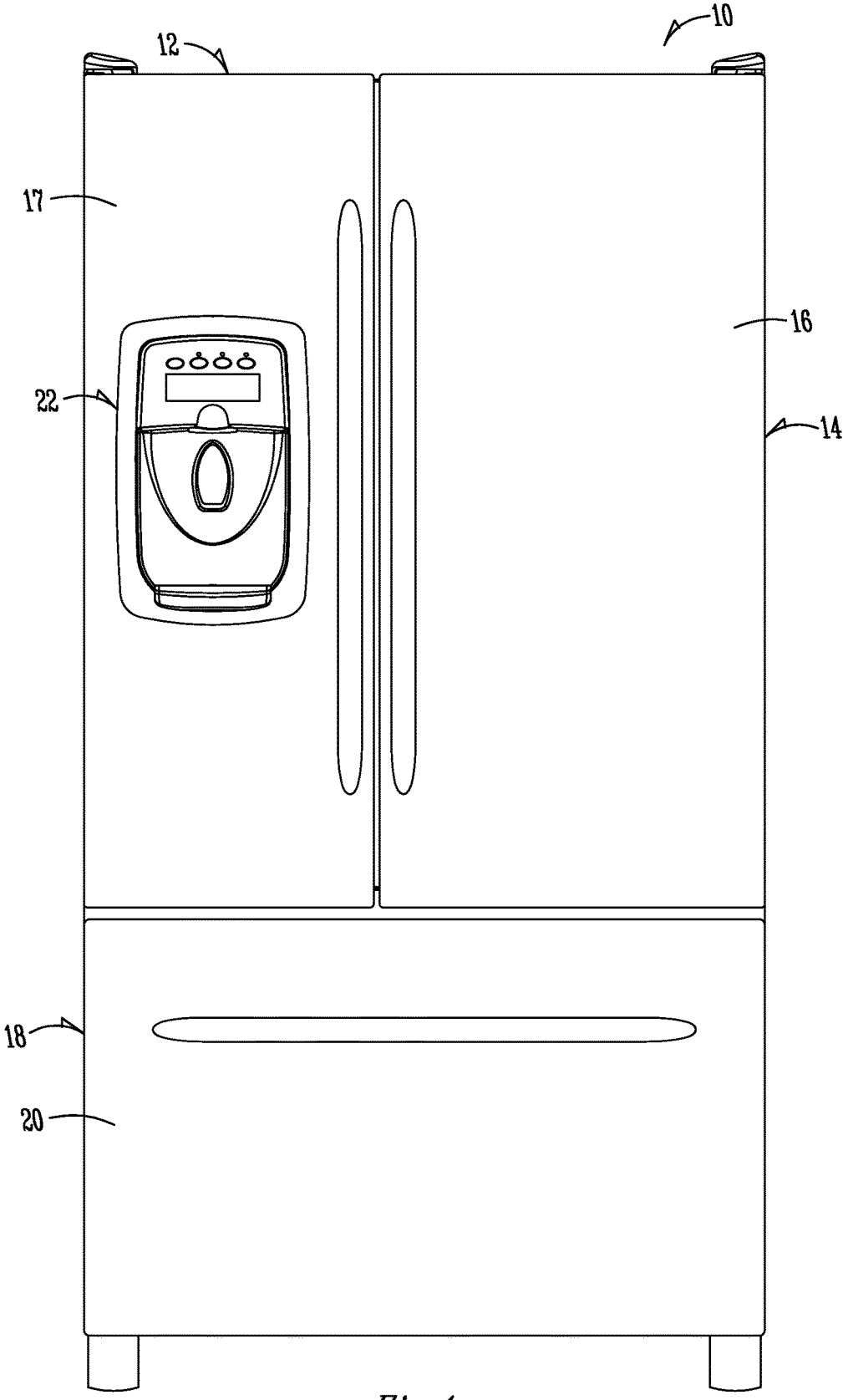
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 14. A dispenser 22 is positioned on one of the doors 16, 17 of the refrigerator compartment 14. The dispenser 22 may be a water dispenser, ice dispenser, other beverage dispenser, or some combination thereof. Furthermore, the dispenser 22 may be placed on any door of the refrigerator 10, or the dispenser 22 may be placed within one of the compartments of the refrigerator 10. For example, the dispenser 22 may be placed at one of the interior walls of the refrigerator compartment 14, thus being part of the cabinet 12. The placement of the dispenser 22 is not to limit the present invention. Positioned generally below the refrigerator compartment 14 is a freezer compartment 18. A freezer door 20 provides access to within the freezer compartment 18. The freezer door 20 of FIG. 1 is shown as a drawer-type door. However, the present invention contemplates that the freezer door 20 may be a drawer, a hinged door, multiple doors, or some combination thereof.

It should also be appreciated that, while the figures show a bottom mount-style refrigerator 10, the present invention contemplates that any style of a refrigerator be included as part of the invention. The figures merely depict one example of a type of refrigerator that can be used with the present invention.

Figure 2:
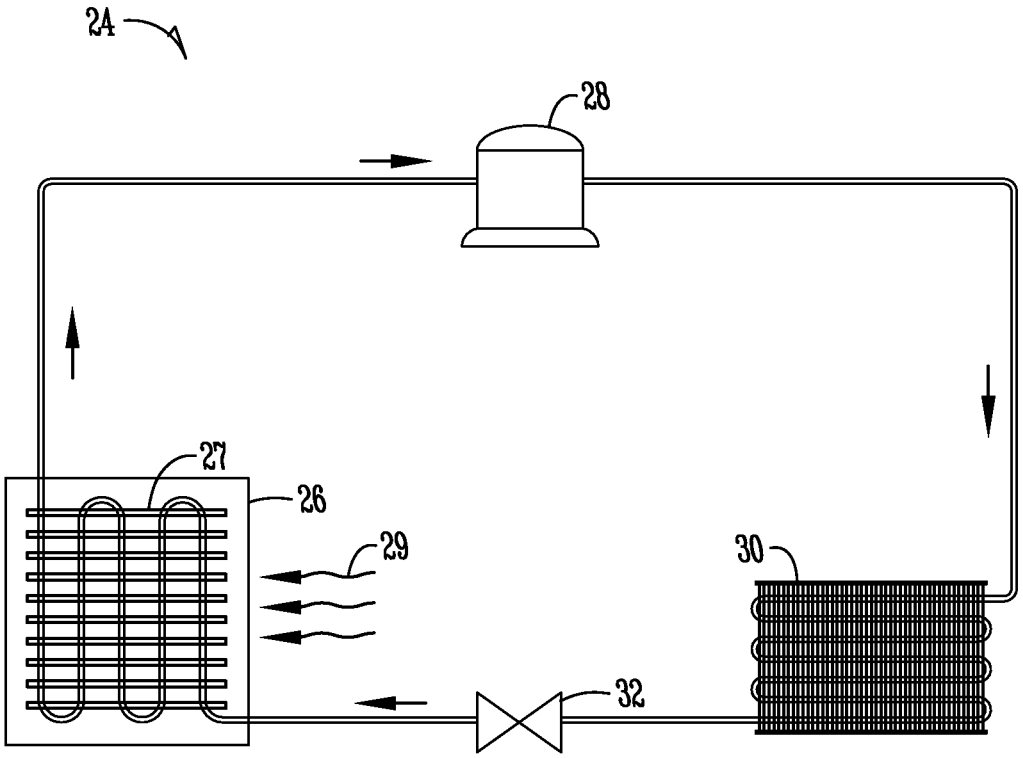
FIG. 2 is a schematic view of a cooling system for a refrigerator including one evaporator.

FIG. 2 is a schematic view of a cooling system 24 for a refrigerator 10 that includes one evaporator 26 to cool air for all of the compartments of the refrigerator 10. As is known, a refrigerant (not shown) is passed through the system 24. The refrigerant enters a compressor 28 as a vapor, and is compressed therein. The compressed refrigerant vapor then travels through a condenser 30, which cools and removes heat to condense the vapor into a liquid. The liquid refrigerant is then passed through an expansion valve 32, where its pressure decreases, causing evaporation of some of the liquid into a vapor. The mixture of liquid and vapor refrigerant is then passed through coils 27 of an evaporator 26. Air, such is that shown by the arrows 29 of FIG. 2, passes over the coils 27 of the evaporator 26. As the air passes over the coils 27, the refrigerant removes heat from the air. Thus, the air on the opposite side of the evaporator 26 is cooled. This cooled air is then directed towards the refrigerator compartment 14, freezer compartment 18, or other compartment(s) within the cabinet 12 of the refrigerator 10.

However, as the evaporator 26 receives the super cooled refrigerant, prolonged use of the evaporator 26 (i.e., prolonged running of the cooling system 24 to constantly cool the refrigerator 10) could result in the coils 27 of the evaporator 26 freezing up and having frost begin to grow thereon. The frost could eventually continue until the coils 27 of the evaporator 26 freeze up, which would not allow the refrigerant to pass through the evaporator 26. This would not allow the cooling system 24 to cool the compartments of the refrigerator 10, and therefore, defrosting of the evaporator 26 is required during periods when the refrigerator 10 does not need the cooling system 24 to run and cool the compartments therein.

Figure 3:
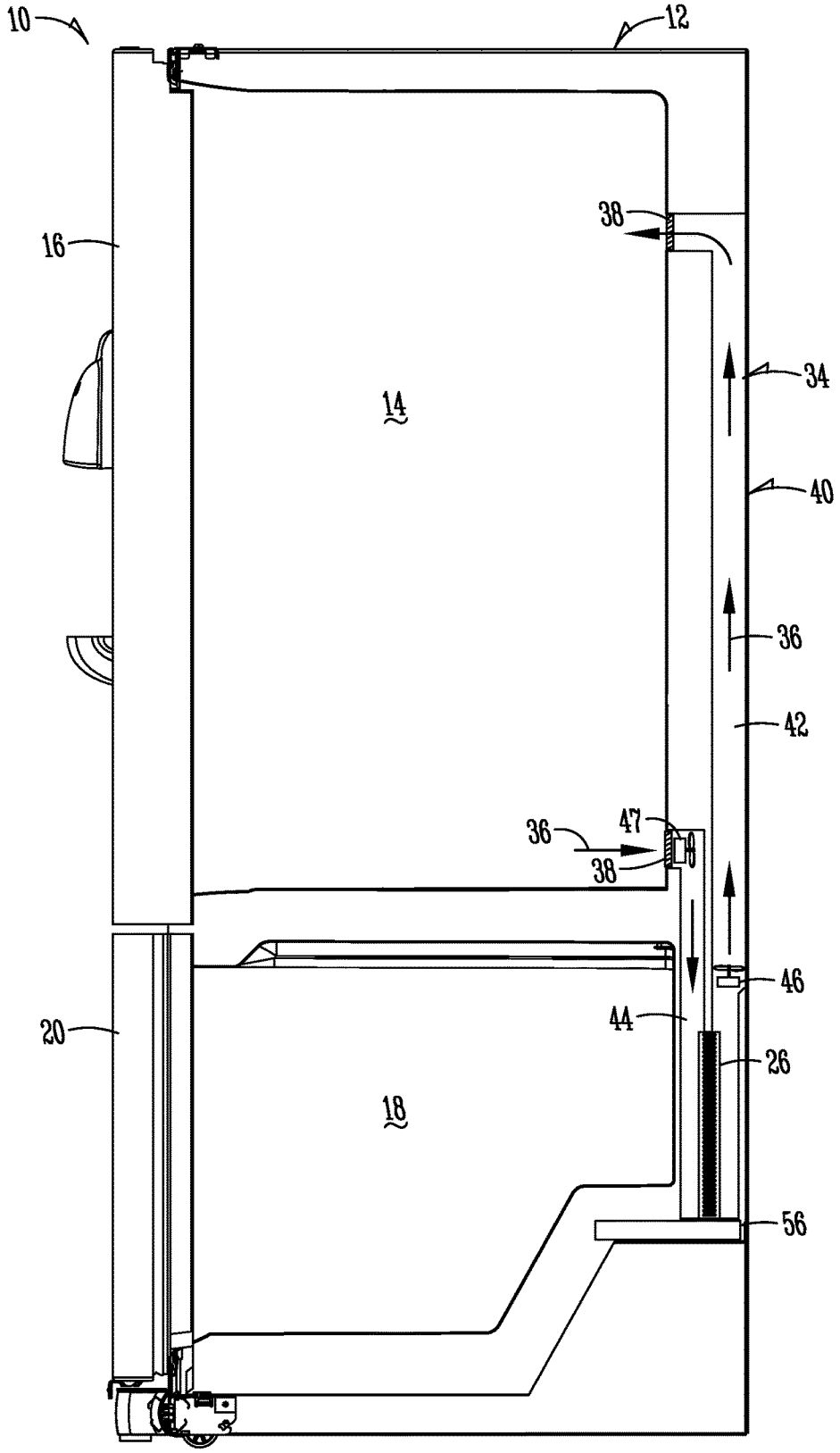
FIG. 3 is a sectional side view of a refrigerator similar to the one shown in FIG. 1 according to an embodiment of the present invention.

Therefore, FIG. 3 is a sectional side view of a refrigerator 10 similar to the one shown in FIG. 1, and including a low energy defrost air loop 34 used to defrost the coils 27 of the evaporator 26. The defrost air loop 34 shown in FIG. 3 utilizes air in the refrigerator compartment 14 that is passed over the evaporator 26 to melt the frost formed on the coils 27 of the evaporator 26. Generally, the air in the refrigerator compartment 14 will be set to a temperature above freezing (i.e., above 32° F.). The temperature in the refrigerator compartment 14 is warm enough to melt ice or frost, which is below freezing. Therefore, the air can be used in place of an electrical heater, which will save energy used by the refrigerator 10.

The refrigerator 10 shown in FIG. 3 includes a duct system 40 including a cooling duct 42 and a return duct 44. The return duct 44 directs air from the refrigerator compartment 14 to the evaporator 26. As noted, the air, shown generally by the arrow 36, is above the freezing temperature. A fan, such as a return fan 47, may be activated to direct air from the refrigerator compartment into the return duct 44 and towards the evaporator 26. This air will pass over and adjacent to the coils 27 of the evaporator 26 to melt any frost that is formed on the evaporator 26. The melted frost will drip into an evaporator pan or tray 56. The melted frost is then able to evaporate into the air surrounding the refrigerator.

In addition, as the air is passed over the coils 27 of the evaporator 26, the air will give off heat to the frost to melt the frost. Thus, once the air has passed the evaporator 26, the air will have a lower temperature than before. The cooled air may then be directed in the cooling duct 42 and returned back to the refrigerator compartment 14 to aid in cooling said refrigerator compartment 14. Thus, the refrigerator compartment 14 is cooled without running the cooling system 24 of the refrigerator 10. To aid in the movement of the air in the direction shown as the arrow 36 in the cooling duct 42, a fan 46, which may be known as a cooling fan, may be turned on to aid in directing the air from the evaporator 26 back to the refrigerator compartment 14. It should be noted that the cooling fan 46 and the return fan 47 will require minimal energy, such that the energy usage of the fans will be less than the energy usage of an electrical heater, which has previously been used to defrost the evaporator 26.

Furthermore, it should be contemplated that the use of the fans may not be required, and the air may flow through the duct system 40 without the need of the fans.

Furthermore, the duct system 40 may include refrigerator compartment baffles 38 at the location of the cooling duct 42 and return duct 44 being exposed to the refrigerator compartment 14. As noted above, the defrosting of the evaporator 26 is generally only done while the cooling system 24 is not running. Therefore, when the cooling system 24 is running, the defrost air loop 34 can be blocked to prevent the air from passing through the air loop. Therefore, the baffles 38 can block air from passing through the duct system 40. However, when the cooling system 24 is off, and the defrost operation is run, the baffles can be opened to move the air through the air loop 34. The baffles 38 may be controlled electrically as needed, using minimal energy to open and close the baffles 38, and the system may include one or a plurality of baffles as needed to best control the temperature of the refrigerator and the defrost system.

However, it should also be contemplated that the duct system 40 of the defrost air loop 34 may also utilize the standard cooling duct for the refrigerant compartment 14. For instance, when the refrigerator compartment 14 is being cooled by the cooling system 24, air will be generally directed from the refrigerator compartment 14 through the evaporator 26 and back into the refrigerator compartment 14. However, during the cooling process, the evaporator will be running, and thus the air from the refrigerator compartment will not stop frost forming on the coils 27 of the evaporator 26. The defrost cycle will generally only occur when the evaporator 26 in cooling 24 are in an off configuration (i.e., not passing refrigerant therethrough).

Figure 4:
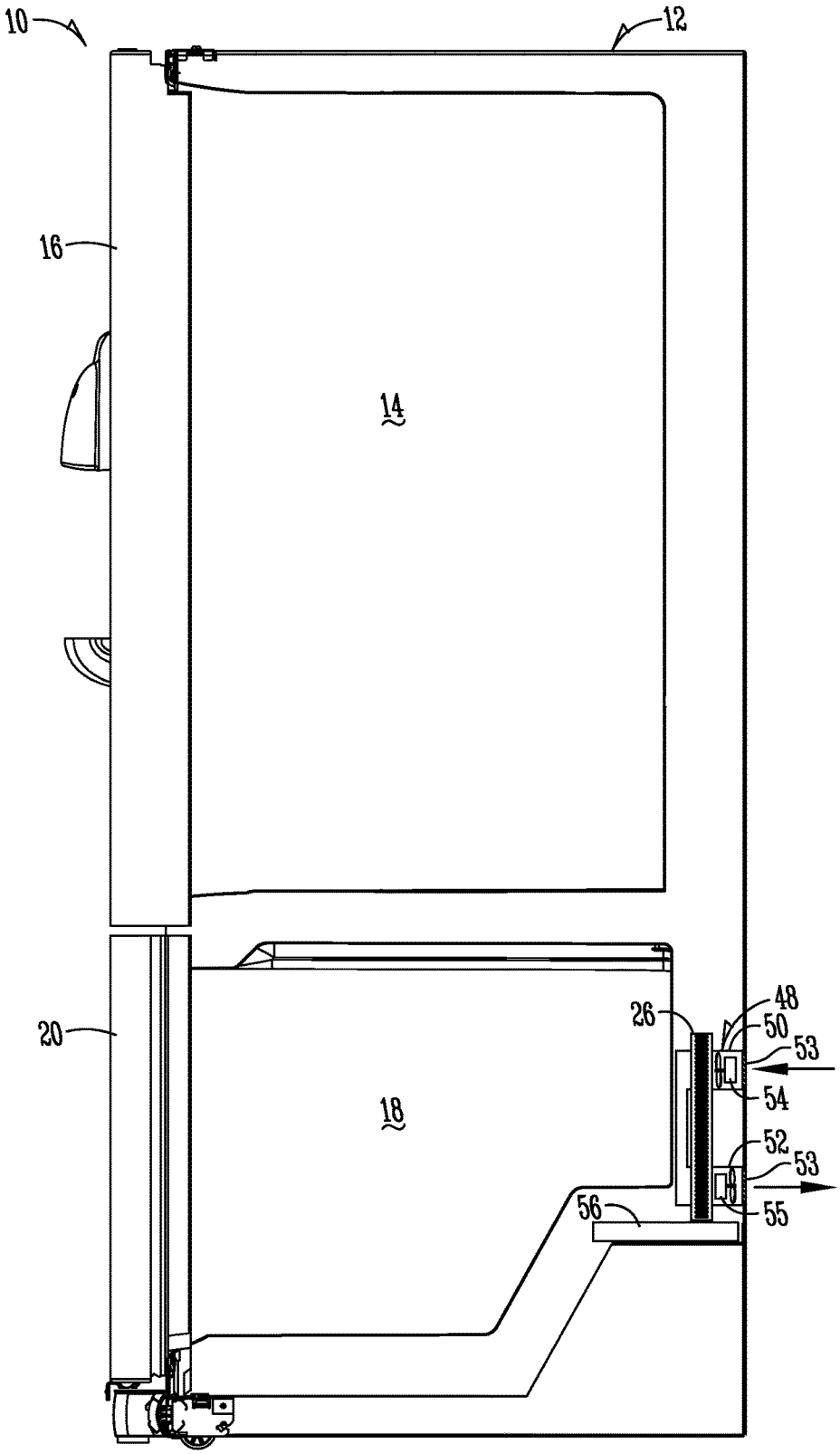
FIG. 4 is a sectional side view of a refrigerator similar to the one shown in FIG. 1 according to an embodiment of the present invention.

FIG. 4 is a sectional view of a refrigerator 10 similar to that shown in FIG. 3, and including another embodiment of the present invention. FIG. 4 shows another configuration of an air loop for defrosting the evaporator 26, which includes external ambient air adjacent the refrigerator 10. As shown in FIG. 4, an external defrost air loop 48 is shown that includes an external air duct 50 and an external return duct 52. Ambient external air is routed or directed into the external air duct 50, and is passed around and adjacent the coils 27 of the evaporator 26. As this air is generally warmer than even the air in the refrigerator compartment 14, the air can quickly and easily melt any frost that has formed on the evaporator 26. Once the air has passed over and adjacent the coils 27 of the evaporator 26, the air is then routed or directed through the external return duct 52 to an area outside of the refrigerator 10. To aid in moving the air from outside the refrigerator 10 to and through the external defrost air loop 48, an external air loop fan 54 and return loop fan 55 may be utilized. As with the embodiment shown in FIG. 3, the fans 54, 55 will generally be low energy fans such that the operation of the fans requires much less energy than that of an electrical heater for defrosting the evaporator 26. Furthermore, it is contemplated that the use of the fans is not required for the invention, as the air may be able to pass through the external air loop 48 without the fans. Also shown in FIG. 4 are baffles located on the backside of the refrigerator at the ends of the external air duct 50 and return duct 52. The baffles 53 can be opened and closed automatically to selectively allow air passage into and through the external defrost air loop 48. At noted with the fans, the energy required to operate the baffles will be minimal such that they will not increase the energy consumption of the refrigerator 10. Also similar to FIG. 3, the embodiment shown in FIG. 4 includes an evaporator pan 56 to catch the melted frost from the evaporator 26 and to allow the melted frost to evaporate into the air adjacent the refrigerator 10.

Figure 5:
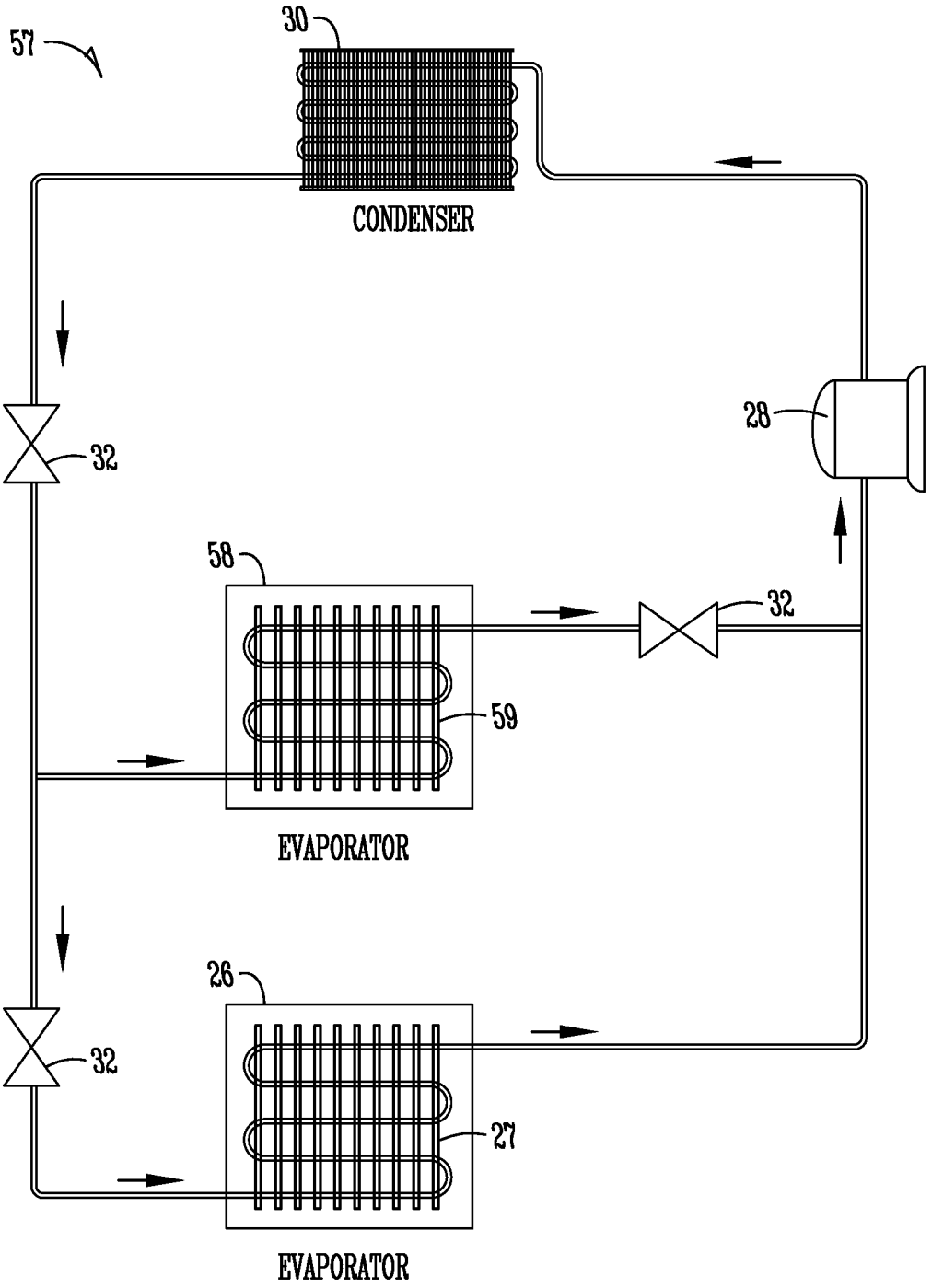
FIG. 5 is a schematic view of a cooling system for a refrigerator that includes two evaporators.

FIG. 5 is a schematic view of a cooling system 57 for refrigerator 10 that includes two evaporators 26, 58. The cooling system 57 works similar to the cooling system shown in FIG. 2, however, the refrigerant, after passing through the expansion valve 32, is separated into two passages. The separated refrigerant is then passed through the coils 27, 59 of the first and second evaporators 26, 58, wherein air is passed over the evaporators to give off heat to cool the air. Therefore, the evaporators 26, 58 may be separately used to cool separate compartments of the refrigerator. For example, one of the evaporators may be used to cool air to cool the refrigerator compartment 14 of the refrigerator 10, while the other evaporated is used to cool the freezer compartment 18 of the refrigerator 10. Having separate evaporators dedicated to separate compartments of the refrigerator 10 allows the refrigerator to run the cooling system 57 less frequently, and to provide greater efficiency for the refrigerator 10.

Figure 6:
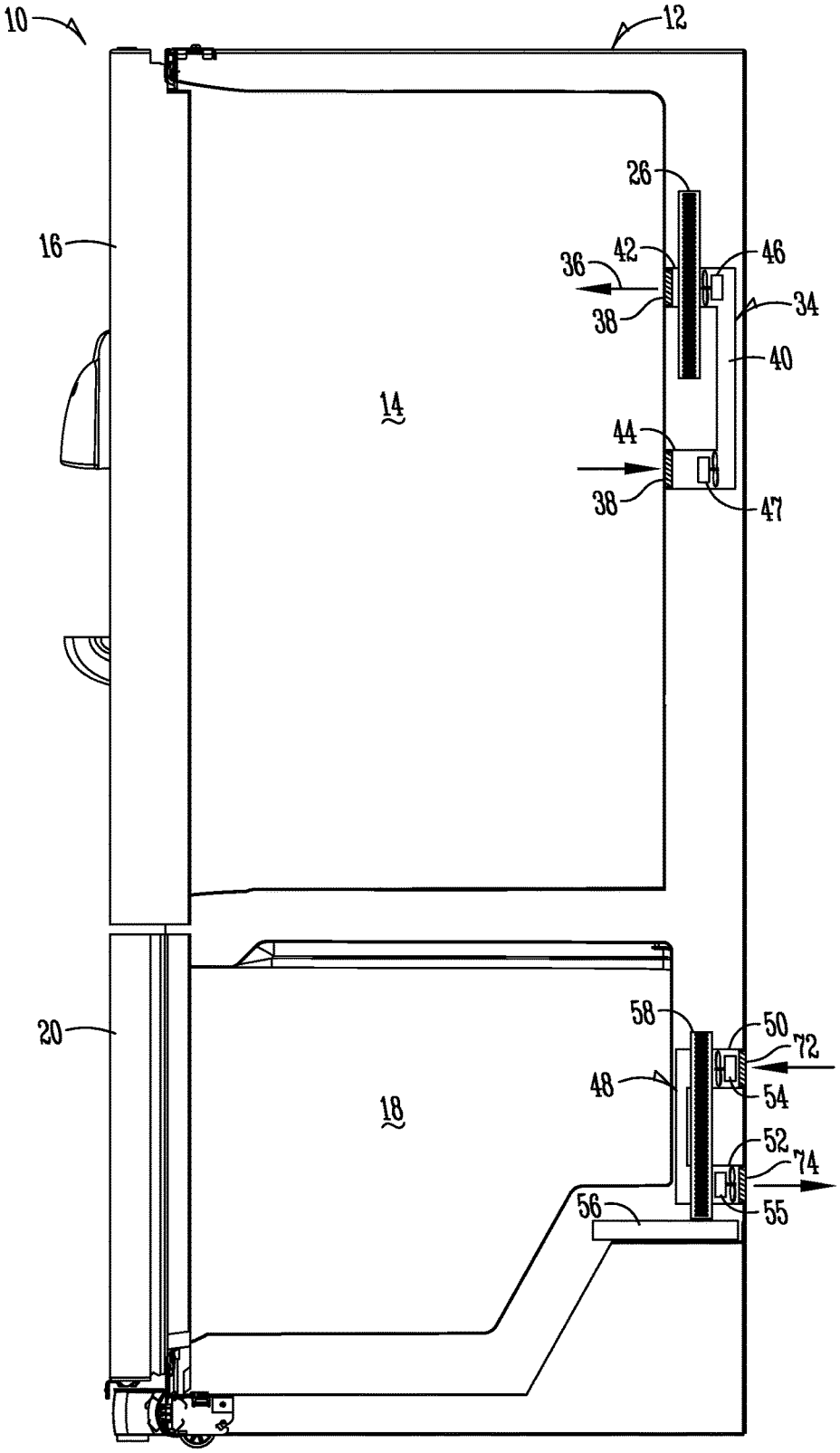
FIG. 6 is a sectional side view of a refrigerator having two evaporators according to an embodiment of the present invention.

FIG. 6 is a sectional view of a refrigerator 10 utilizing the two or dual evaporator cooling system 57. As shown in FIG. 6, a first evaporator 26 is used to cool the refrigerator compartment 14, while a second evaporator 58 is used to cool the freezer compartment 18. In addition, FIG. 6 shows the refrigerator compartment defrost air loop 34 used to defrost the first evaporator 26, and the external defrost air loop 48 used to defrost the second evaporator 58. The defrost air loops 34, 48 operate generally as indicated above. For example, the refrigerator compartment defrost air loop 34 directs above-freezing temperature air of the refrigerator compartment 14 and passes that air through or over the coils of the evaporator 26 to melt any frost that has formed on the coils of the evaporator 26. That air is then continued on and recycled back into the refrigerator compartment 14 to aid in cooling said refrigerator compartment 14. The flow of the refrigerator compartment air 36 may be controlled by baffles 38 positioned in the cabinet 12 of the refrigerator compartment 14 to selectively allow air to pass through the defrost air loop 34.

Likewise, the external defrost air loop 48 directs external air from adjacent the refrigerator 10 over and adjacent to the coils of the second evaporator 58 to melt any frost that has formed on the coils of the evaporator 58. The air is then directed or returned outside or externally of the refrigerator 10. For both defrost air loops 34, 48, the melted frost of the evaporators can be collected in an evaporator pan 56, where it is allowed to evaporate into the air.

Furthermore, FIG. 6 shows the use of first and second external baffles 72, 74 to selectively allow air to be directed in the external defrost air loop 48. While FIG. 6 shows the refrigerator defrost air loop 34 being used to defrost the evaporator 26 used to cool the refrigerator compartment 14, and the external defrost air loop 48 used to defrost the evaporator 58 used to cool the freezer compartment 18, it should be appreciated that either air loop can be used to defrost either evaporator. However, as the evaporator used to cool air to cool the freezer compartment 18 will generally be run more often as the freezer compartment 18 is set at a lower temperature than the refrigerator compartment 14, the use of the warmer external air may be beneficial to increase the rate of defrost of the frost on the evaporator used to cool the freezer compartment 18. The present invention also contemplates that only one defrost air loop be used to defrost both of the evaporators. In such a situation, the system would require additional air ducts and/or baffles that could be used to direct air to one or both of the evaporators to defrost the coils of the evaporators.

As shown, the low energy defrost systems of the present invention include many advantages. For example, the defrost systems of the air loops 34, 48 provide systems and methods for defrosting the evaporator coils of the refrigerator without the need for an electrical heater on or adjacent the evaporators. As noted previously, electrical heaters require more energy to operate the heaters, which then increases the energy usage of the refrigerator. Therefore, the use of the present invention provides a low energy or more energy efficient way of running a refrigerator. Thus, the less energy used, the lower the cost that will be passed to the consumer of the refrigerator. While the systems and methods of the present invention can include baffles and fans, which may be electrically run, the electricity or energy required to operate the baffles and fans will generally be much less than that required to operate an electrical heater. Therefore, embodiments including the use of the fans and baffles will still provide a more efficient and less energy-using refrigerator. Furthermore, when refrigerator compartment air is used to defrost the evaporator, the air is re-cooled by the melting of the frost on the evaporator. Thus, the re-cooled air is then redirected into the refrigerator compartment to aid in cooling said compartment. The air has been re-cooled without turning on the cooling system of the refrigerator, which additionally increases the efficiency and lessens the energy consumption of the refrigerator.

Figure 7:
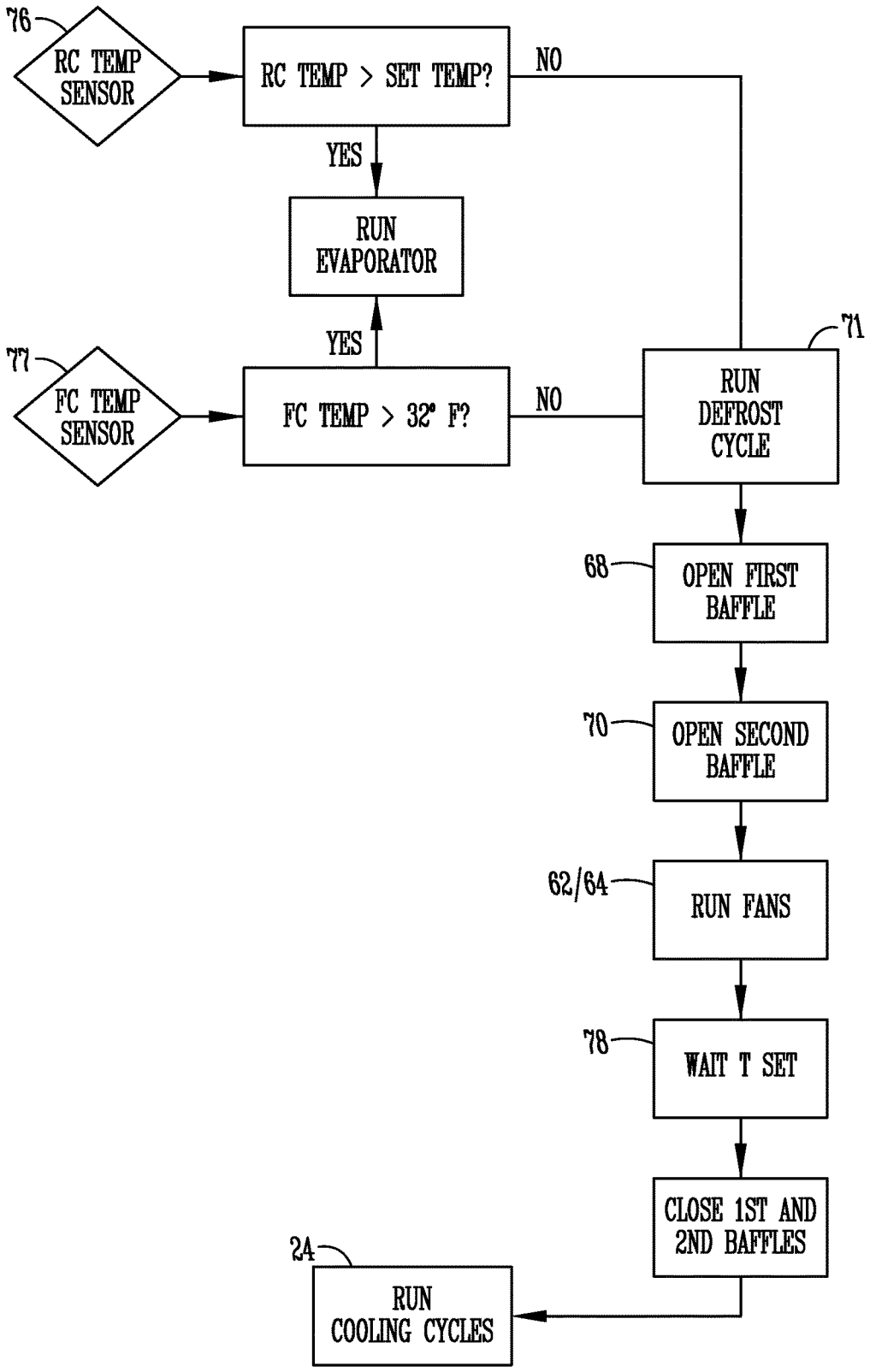
FIG. 7 is a diagram of a low energy defrost system according to an embodiment of the present invention.

FIG. 7 is a diagram for the operation of a low energy defrost system as has been described according to the embodiments of the present invention. Temperature sensors 76, 77 in the refrigerator compartment 14 and freezer compartment 18 determine the temperature in the compartments. An intelligent control or other apparatus analyzes the temperature of the sensors 76, 77 to determine whether the present temperatures in the compartments are greater than the set temperatures for each of the compartments. If the answer for either of the compartments is yes, the cooling system, including the evaporator, is run to provide more cooled air to lower the temperature below the set or predetermined temperatures of the compartments. For example, as shown in FIG. 7, the freezer compartment is generally set at or below 32° F., which is freezing temperature. Once the temperature rises above the freezing temperature, the evaporator and cooling system can be run to reduce the temperature in the freezing compartment below the freezing temperature.

Once the temperatures for both the refrigerator compartment and freezer compartment are below the set or programmed temperatures, the defrost cycle 71 can be run by the refrigerator 10. For example, as shown in FIG. 7, the defrost cycle 71 may include opening a first baffle 68 and/or a second baffle 70. The baffles provide access to the duct systems of the defrost systems. First and second fans 62, 64 may be run at each end of the duct systems to aid in directing air through the duct system and over or adjacent to the evaporator. As the air, either from the refrigerator compartment or from external of the refrigerator, is above freezing, the air will aid in melting any frost formed on the evaporator. The defrost cycle will run for an amount of time, which is shown in FIG. 7 as $T_{set}$. Thus, the defrost cycle may have a set amount of time that the defrost cycle is run to melt any frost formed on the evaporators. However, it is also contemplated that the defrost cycle can run until the temperature of the refrigerator compartment and/or freezer compartment has risen above the preset or programmed temperatures of the compartments. Once the defrost cycle has finished its operation, the first and second baffles can be closed to prevent the warmed air from passing over or adjacent to the evaporator. Once the baffles are closed, the cooling cycles can be run to begin providing cooled air to the compartments of the refrigerator.

While FIG. 7 shows and describes an operation of the defrost cycle for the refrigerator of the present invention, it should be contemplated that other steps and/or methods may be used. For example, FIG. 7 does not specifically disclose whether the refrigerator includes a single or dual evaporator refrigerator. Thus, more steps may be added to the diagram shown in FIG. 7 as needed to accommodate the more components of a dual evaporator system. The example of FIG. 7 also does not show the steps for when one defrost system defrosts two or more evaporators, which, as described above, is also contemplated by the present invention. Furthermore, as noted above, the use of fans and baffles are not required for all embodiments of the present invention. The diagram shown in FIG. 7 also does not explicitly state where the melted frost of the evaporators is directed either. Note that the diagram of FIG. 7 is not the only method that can be used for the defrost system of the refrigerator.

The foregoing description has been presented for purposes of illustration and description. It is not intended to be an exhaustive list or limit the invention to precise forms disclosed. It is contemplated that other alternative processes and systems obvious to those skilled in the art are considered to be included in the invention. The description is merely examples of embodiments. For example, the present invention contemplates that instead of having only external or only refrigerator compartment air used to defrost the evaporators, the present invention contemplates that a combination of air from the refrigerator compartment and external air can be used. Furthermore, as discussed above, when refrigerator compartment air is used, an additional duct is not needed to direct the air. For example, the system could use existing ducts for cooling the refrigerator compartment in reverse to direct air from the refrigerator compartment to the evaporator to melt any frost formed on the evaporator. It is understood that any other modifications, substitutions, and/or additions may be made, which are within the intended spirit and scope of the invention. From the foregoing, it can be seen that the present invention accomplishes at least all of the stated objectives.

What is claimed is:

1. A refrigerator, comprising:

a refrigerator compartment;

a freezer compartment;

a first evaporator for cooling the refrigerator compartment;

a second evaporator for cooling the freezer compartment;

a defrost air loop for directing refrigerator compartment air from the refrigerator compartment to the first evaporator and back to the refrigerator compartment, wherein the refrigerator compartment air is configured to melt frost on the first evaporator and cool, and wherein the cooled air is returned to the refrigerator compartment;

an external defrost air loop for drawing ambient air from an external air source outside of the refrigerator, wherein the ambient air passes over the second evaporator and is circulated through the external defrost loop to melt frost on the second evaporator before being directed back to the external air source without the ambient air mixing with air from the freezer compartment or with air from the refrigerator compartment; and the external defrost air loop comprising an inlet fan positioned adjacent an external inlet to actively draw the ambient air into the external defrost air loop.

2. The refrigerator of claim 1, further comprising an evaporator pan operably connected to the first evaporator and configured to store the melted frost of the first evaporator.

3. The refrigerator of claim 1, wherein the wherein the defrost air loop comprises a duct system.

4. The refrigerator of claim 3, wherein the duct system further comprises a fan.

5. The refrigerator of claim 4, wherein the inlet fan is also used to draw the ambient air towards the second evaporator, and an outlet fan is used to direct the air back to an external location.

6. The refrigerator of claim 5, further comprising first and second external baffles to selectively allow air to be directed in the external defrost air loop.

7. The refrigerator of claim 1, wherein the refrigerator compartment defrost air loop comprises a duct system with at least one fan for directing air through the duct system.

8. A method of defrosting a first evaporator and a second evaporator of a refrigerator, wherein the first evaporator cools a first compartment and the second evaporator cools a second compartment, the method comprising:

drawing, via an inlet fan adjacent an opening, ambient air from a source external the refrigerator and directing the ambient air adjacent the first evaporator and back towards the external source to defrost the first evaporator; and directing air above freezing temperature from the second compartment to the second evaporator and back to the second compartment to defrost the second evaporator.

9. The method of claim 8, further comprising directing the air from the second evaporator back towards the second compartment to cool the second compartment.

10. The method of claim 9, wherein the first compartment is a freezer compartment and the second compartment is a refrigerator compartment.

11. The method of claim 10, wherein the step of drawing and directing ambient air from the source external the refrigerator adjacent the first evaporator and back towards the source to defrost the first evaporator comprises returning the ambient air through an external duct system with at least one fan positioned within the duct system adjacent a second external opening.

12. The method of claim 10, the step of directing air above freezing temperature from the second compartment to the second evaporator to defrost the second evaporator comprises passing the air above freezing temperature via a defrost air loop comprising a duct system between the second evaporator and the second compartment.

13. The method of claim 12, wherein the defrost air loop further comprises at least one fan for aiding to direct the air.

14. A refrigerator, comprising:

a refrigerator compartment;

a freezer compartment;

a refrigerator evaporator for cooling the refrigerator compartment; and a freezer evaporator for cooling the freezer compartment;

wherein air from the refrigerator compartment is used to defrost the refrigerator evaporator, external air is used to defrost the freezer evaporator, and the air from the refrigerator compartment used to defrost the refrigerator evaporator and the external air used to defrost the freezer evaporator pass through separate air flow paths without mixing refrigerator compartment air and ambient air.

15. The refrigerator of claim 14, further comprising a cooling duct from the refrigerator compartment, and a separate return duct from the refrigerator compartment to the refrigerator evaporator.

16. The refrigerator of claim 15, further comprising at least one fan in either the cooling duct or the return duct.

17. The refrigerator of claim 14, wherein the air that is used to defrost the refrigerator evaporator is directed back into the refrigerator compartment to aid cooling the refrigerator compartment.

* * * * *